US006468680B1

(12) United States Patent
Waldenström et al.

(10) Patent No.: US 6,468,680 B1
(45) Date of Patent: Oct. 22, 2002

(54) CEMENTED CARBIDE INSERT WITH BINDER PHASE ENRICHED SURFACE ZONE

(75) Inventors: Mats Waldenström, Bromma; Leif Åkesson, Älvsjö, both of (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/720,654

(22) PCT Filed: Jul. 5, 1999

(86) PCT No.: PCT/SE99/01220

§ 371 (c)(1),
(2), (4) Date: Feb. 20, 2001

(87) PCT Pub. No.: WO00/03048

PCT Pub. Date: Jan. 20, 2000

(30) Foreign Application Priority Data

Jul. 9, 1998 (SE) ..... 9802487

(51) Int. Cl.[7] ..... C22C 29/08

(52) U.S. Cl. ..... 428/698; 75/243; 419/26; 419/29; 419/35; 428/325; 428/469; 428/472

(58) Field of Search ..... 428/472, 469, 428/325, 698; 75/243; 419/26, 29, 35

(56) References Cited

U.S. PATENT DOCUMENTS

| | | | | |
|---|---|---|---|---|
| 4,277,283 A | | 7/1981 | Tobioka et al. | |
| 4,610,931 A | | 9/1986 | Nemeth et al. | |
| 4,830,930 A | | 5/1989 | Taniguchi et al. | |
| 5,106,674 A | | 4/1992 | Okada et al. | |
| 5,380,408 A | | 1/1995 | Svensson | |
| 5,484,468 A | | 1/1996 | Östlund et al. | |
| 5,494,635 A | * | 2/1996 | Bennett | 419/14 |
| 5,505,902 A | | 4/1996 | Fischer et al. | |
| 5,529,804 A | | 6/1996 | Bonneau et al. | |
| 5,649,279 A | | 7/1997 | Gustafson et al. | |
| 5,856,626 A | * | 1/1999 | Fischer et al. | 75/240 |

FOREIGN PATENT DOCUMENTS

| | | |
|---|---|---|
| EP | 240879 | 10/1987 |
| GB | 346473 | 4/1931 |
| WO | 09/03691 | 1/1998 |
| WO | 98/00257 | 1/1998 |

OTHER PUBLICATIONS

U.S. patent application No. 09/242,683, Lindskog et al., filed Aug. 1999.

* cited by examiner

*Primary Examiner*—Archene Turner
(74) *Attorney, Agent, or Firm*—Burns, Doane, Swecker & Mathis, LLP

(57) ABSTRACT

The present invention relates to a coated cemented carbide insert with a binder phase enriched surface zone. The WC-grains have an average grain size in the range 1.0–3.5 μm, preferably 1.3–3.0 μm and the number of WC-grains larger than 2 times the average grain size is less than 10 grains/cm$^2$ measured on a representative polished section 0.5 cm$^2$ large, preferably less than 5 grains/cm$^2$, and the number larger than 3 times the average grain size is less than 5 grains/cm$^2$, preferably less than 3 grains/cm$^2$. The cemented carbide is made by powder metallurgical methods and is in particular characterized in that the cooling rate, CR, from the sintering temperature, ST, exhibits the relationship $10<CR\cdot(ST-1300)/1000<17$.

11 Claims, 1 Drawing Sheet

CEMENTED CARBIDE INSERT WITH BINDER PHASE ENRICHED SURFACE ZONE

FIELD OF THE INVENTION

The present invention relates to coated cemented carbide cutting tool inserts with a binder phase enriched surface zone, particularly useful for turning and drilling in steels and stainless steels.

BACKGROUND OF THE INVENTION

Coated cemented carbide inserts with binder phase enriched surface zones are today used to a great extent for machining of steel and stainless materials. Through the binder phase enriched surface zone an extension of the application area is obtained.

Methods of producing binder phase enriched surface zones on cemented carbides containing WC, gamma phase. (Ti,Ta,Nb)C, and binder phase are known as gradient sintering and have been known for some time, e.g., through Tobioka (U.S. Pat. No. 4,277,283, Nemeth (U.S. Pat. No. 4,610,931), Taniguchi (U.S. Pat. No. 4,830,930), Okada (U.S. Pat. No. 5,106,674 and Gustafson (U.S. Pat. No. 5,649,279).

Conventional cemented carbide inserts are produced by powder metallurgical methods including milling of a powder mixture forming the hard constituents and the binder phase, pressing and sintering. The milling operation is an intensive milling in mills of different sizes and with the aid of milling bodies. The milling time is of the order of several hours up to several days. Such processing is believed to be necessary in order to obtain a uniform distribution of the binder phase in the milled mixture. It is further believed that the intensive milling creates a reactivity of the mixture which further promotes the formation of a dense structure. However, milling has its disadvantages. During the long milling time the milling bodies are worn and contaminate the milled mixture. Furthermore, even after an extended milling a random rather than an ideal homogeneous mixture may be obtained. Thus, the properties of the sintered cemented carbide containing two or more components depend on how the starting materials are mixed. Further, the extensive milling process generates a large fraction of very fine grained carbide particles that during the sintering process will cause a in many cases unwanted grain growth. The grain growth process often leads to the formation of a fraction of very large carbide particles especially of WC, which can deteriorate the thermomechanical properties of the cutting insert.

There exist alternative technologies to intensive milling for production of cemented carbide, for example, use of particles coated with binder phase metal. The coating methods include fluidized bed methods, solgel techniques, electrolytic coating, PVD coating or other methods such as disclosed in e.g. GB 346,473, U.S. Pat. Nos. 5,529,804 or 5,505,902. Coated carbide particles can be mixed with additional amounts of cobalt and other carbide powders to obtain the desired final material composition, pressed and sintered to a dense structure.

SUMMARY OF THE INVENTION

It has now surprisingly been found that cemented carbide inserts with binder enriched surface zone made from powder mixtures with cobalt coated hard constituents with narrow grain size distributions and without conventional milling have excellent cutting performance in steels and stainless steels in turning and drilling under both dry and wet conditions. Furthermore, it has been found that due to the very uniformly distributed binder phase on the carbide particles, it is possible to use a lower sintering temperature and still get a dense structure, especially valid at lower binder contents. It has also been found that a much higher cooling rate in combination with the lower sintering temperature gives the most optimal binder enriched surface structure for the application area mentioned above.

According to a first aspect, the present invention provides a coated cemented carbide comprising WC, 2–10 wt-% Co, 4–15 wt-% cubic carbides with a binder phase enriched surface zone essentially free of gamma phase, the WC forming grains, the WC-grains have an average grain size in the range 1.0–3.5 $\mu$m, and that the number of WC-grains larger than 2 times the average grain size is less than 10 grains/cm$^2$ measured on a representative polished section 0.5 cm$^2$ in area, and the number of grains in area larger than 3 times the average grain size is less than 5 grains/cm$^2$ as measured over the section area.

DETAILED DESCRIPTION OF THE INVENTION

Figure 1:
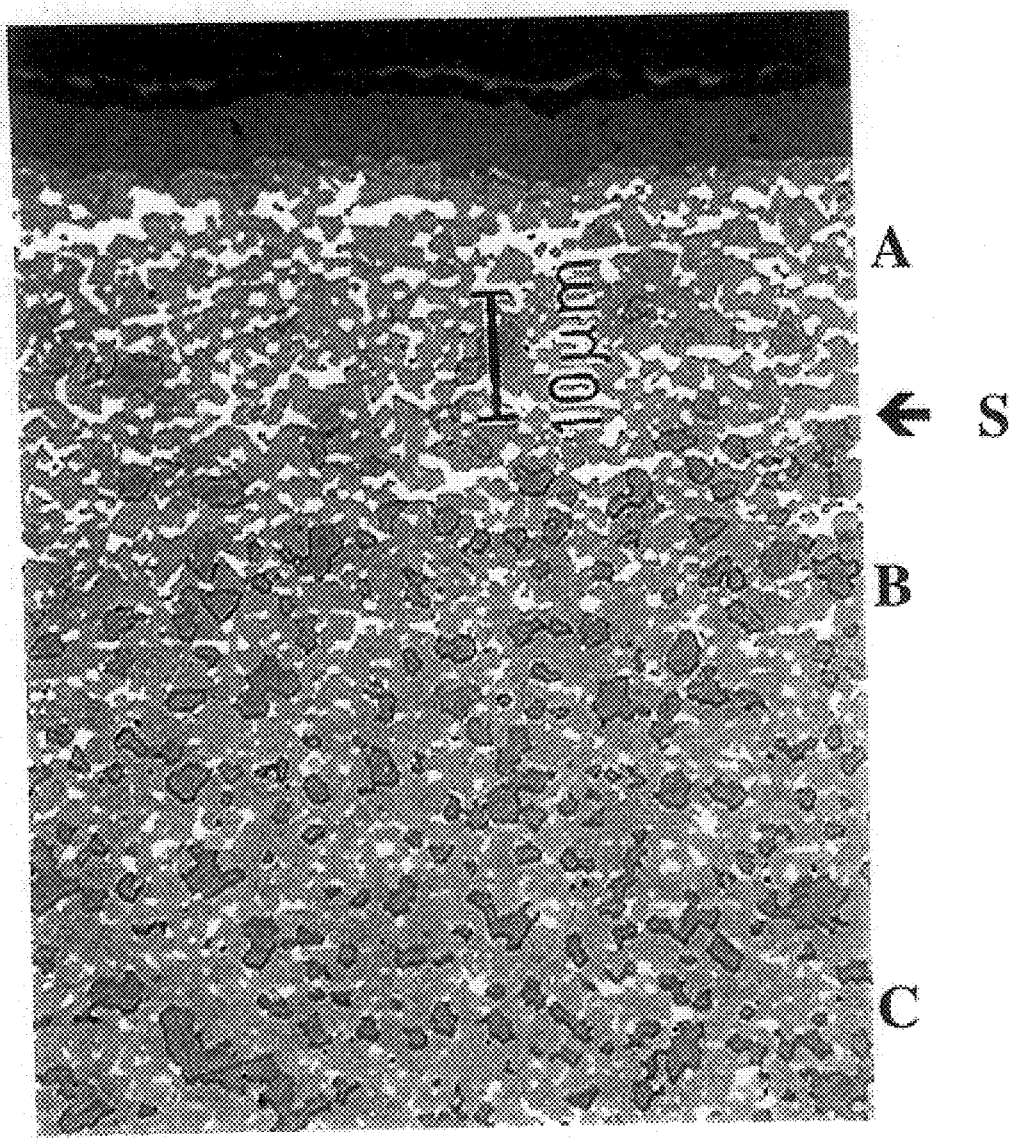
FIG. 1 shows in 1300×magnification the surface zone an insert according to the invention.

An embodiment of the present invention is illustrated in FIG. 1 where:

A—the outer part of the surface zone essentially free of gamma phase

B—the inner part of the surface zone containing gramma phase

C—unaffected substrate

S—striation

According to the present invention there is now provided a cemented carbide with a <65 $\mu$m, preferably 20–40 $\mu$m, thick binder phase enriched surface zone, A+B. The outer part, A, of this binder phase enriched surface zone, at least 5 $\mu$m. preferably <20 $\mu$m thick, is essentially free of gamma phase. The inner part, B, of the surface zone, at least 10 $\mu$m, preferably <30 $\mu$m, thick, contains gamma phase as well as stratified binder phase layers, S. The stratified binder phase layers are in this inner part, part B, well developed whereas they are thin and with very small spread in the outer part of the surface zone, part A. The binder phase content of the binder phase enriched surface zone has a maximum in the inner part, B, of 1.5–4, preferably 2–3, times the nominal binder phase content. In addition, the tungsten content of the inner part, B, of the surface zone is <0.95, preferably 0.75–0.9, of the nominal tungsten content. The binder phase enriched surface zone as well as an about 100–300 $\mu$m thick zone below it, part C, with essentially nominal content of WC, gamma phase and binder phase contain no graphite. However, in the interior of the cemented carbide according to the invention there is a C-porosity of C06–C08. On top of the cemented carbide surface there is a thin, 1–2 $\mu$m, cobalt and/or graphite layer.

The WC-grains have an average grain size in the range 1.0–3.5 $\mu$m, preferably 1.3–3.0 $\mu$m and a very narrow grain size distribution. The number of WC-grains larger than 2 times the average grain size is less than 10 grains/cm$^2$ measured on a representative polished section 0.5 cm2 in area preferably less than 5 grains/cm$^2$, and the number of grains larger than 3 times the average grain size is less than 5 grains/cm$^2$, preferably less than 3 grains/cm$^2$. In addition, the gamma phase, when present, exhibits a lower tendency to form long range skeleton, compared to conventional cemented carbide.

The amount of Co-based binder phase can vary between 2 and 10% by weight, preferably between 4 and 8% by weight, most preferably between 5.5 and 7% by weight. The amount of gamma phase forming elements can be varied rather freely. The process works on cemented carbides with varying amount of titanium, tantalum, niobium, vanadium, tungsten and/or molybdenum. The optimum combination of toughness and deformation resistance is achieved with a total amount of cubic carbides TiC, TaC, NbC, etc corresponding to 4–15% by weight, preferably 7–10% by weight. In order to obtain the desired microstructure, nitrogen has be added, either through the powder or through the sintering process. As a result the cemented carbide contains between 0.1 and 3% by weight N per % by weight of group IVB and VB elements. Although the material contains carbonitride rather than carbide it is generally referred to as cemented carbide.

According to the method of the present invention the cemented carbide is manufactured by jetmilling/sieving a WC-powder to a powder with narrow grain size distribution in which the fine and coarse grains are eliminated. To obtain the above-mentioned narrow grain size distribution it has been found that the WC-grains of the powder shall have a size within the range 0.1 $d_m$–3 $d_m$, preferably 0.2 $d_m$–2 $d_m$ where dm is desired average grain size. This WC powder is then coated with Co according to any of the above mentioned US-patents. The WC-powder is carefully wet mixed with cubic carbides and an optimum amount of carbonitrides or nitrides to produce a slurry, possibly with more Co to obtain the desired final composition, and pressing agent. The optimum amount of nitrogen depends on the amount of gamma phase and can vary between 0.1 and 3% by weight per % by weight of group RVB and VB elements.

The amount of carbon required to achieve the desired stratified structure according to the present invention coincides with the eutectic composition, i.e. graphite saturation. The optimum amount of carbon is, thus, a function of all other elements of the composition. The carbon content can be controlled either by a very accurate blending and sintering procedure or by a carburization treatment in connection with the sintering.

Furthermore, in order to avoid sedimentation of the coated WC-particles thickeners are added according to WO 98/00257. The mixing shall be such that a uniform mixture is obtained without milling i.e. no reduction in grain size shall take place. The slurry is dried by spray drying. From the spray dried powder cemented carbide bodies are pressed and sintered.

The pressed bodies containing an optimum amount of carbon are sintered in an inert atmosphere or in vacuum, 15 to 180 min at a sintering temperature of 1350–1420° C., followed by slow controlled cooling, 75–240° C./h, preferably 85–200° C./h, through the solidification region, 1295–1230° C., preferably 1290–1250° C. The cooling rate must be optimised together with the sintering temperature. This relationship can be expressed as the $$SP\text{-value}=CR\cdot(ST-1300)/1000$$

where CR is the cooling rate in ° C./h and ST is the sintering temperature in ° C.

According to the invention improved cutting properties are achieved if the SP-value is between 10 and 17, preferably between 11 and 16 inclusive of the limits.

An alternative route includes sintering a slightly subeutectic body in a carburising atmosphere, containing a mixture of $CH_4/H_2$ and/or $CO_2/CO$, 30–180 min at 1350–1420° C. followed by slow cooling according to above in the same atmosphere, preferably in an inert atmosphere or vacuum.

Cemented carbide inserts according to the invention are preferably coated with thin wear resistant coatings with CVD- or PVD-technique. Preferably there is deposited an innermost coating of carbide, nitride or carbonitride, preferably of titanium, and an outer coating of preferably alumina. Prior to the deposition the cobalt- and/or graphite layer on top of the cemented carbide surface is removed e.g. by electrolytic etching or blasting, according to e.g. U.S. Pat. No. 5,380,408.

The present invention will now be further described by reference to the following examples, which are illustrative rather than restritive.

EXAMPLE 1

Cemented carbide tool inserts of the type CNMG 120408-PM, an insert for turning, with the composition 6.5 wt % Co, 3.6 wt % TaC, 2.4 wt % NbC, 0.4 wt % TiCN and 2.2 wt % TiC and remainder WC were produced according to the invention from a jetmilled/sieved WC-powder with an average grain size of 2.3 μm and grain sizes in the range 0.7–3.9 μm. Cobalt coated WC, WC-2 wt % Co, prepared according to U.S. Pat. No. 5,505,902 was carefully deagglomerated in a laboratory jetmill equipment, mixed with additional amounts of Co and deagglomerated uncoated (Ta, Nb)C, NbC, TiCN and (Ti, W)C powders to obtain the desired material composition. The mixing was carried out in an ethanol and water solution (0.25 l fluid per kg cemented carbide powder) for 2 hours in a laboratory mixer and the batch size was 10 kg. Furthermore, 2 wt % lubricant was added to the slurry. The carbon balance was adjusted with carbon black to 0.25 wt % overstoichiometric carbon. After spray drying, the inserts were pressed and sintered in $H_2$ up to 450° C. for dewaxing and further in vacuum to 1350° C. and after that in protective atmosphere of Ar for 1 h at 1380° C. according to standard practice. The cooling was performed with a well controlled temperature decrease of 170° C./h within the temperature interval 1290 to 1240° C., i.e. with the SP-value equal to 13.6, in the same protective atmosphere as during the sintering. After that, the cooling continued as normal furnace cooling while maintaining the protective atmosphere.

The structure in the binder phase enriched surface zone of the inserts consisted of an about 7 μm thick moderately binder phase enriched outer part essentially free of gamma phase, part A, in which the stratified binder phase structure was weakly developed. Below this outer part there was a 25 μm thick zone containing gamma phase and with a strong binder phase enrichment as a stratified binder phase structure, part B. The maximum cobalt-content in this part was about 20 weight-%. Further below this part, B, there was a zone, part C, about 150–200 μm thick with essentially nominal content of gamma phase and binder phase but without free graphite. In the inner of the insert graphite porosity was present up to C08. The average grain size of the WC was about 2.5 μm, and the number of grains larger than 5 μm was found to be <5 grains/cm$^2$ on a polished section and the number larger than 7.5 μm was <2 grains/cm$^2$. On the surface there was a thin film of cobalt and graphite. This film was removed by an electrochemical method in connection with the edge rounding treatment. The inserts were coated according to known CVD-technique with an about 10 μm thick coating of TiCN and $Al_2O_3$.

EXAMPLE 2

As reference a similar powder mixture as in example 1 was produced by conventional milling of uncoated hard constituents. Inserts of type CNMG 120408-PM were pressed and sintered according to an identical sintering cycle as in example 1, except with a sintering temperature of 1450° C., giving an SP-value equal to 25.5. The inserts were etched, edge-rounded and CVD coated according to example 1.

The structure and average grain size of the inserts was essentially identical to that of example 1 except for three aspects:

an apparent broader grain size distribution within the whole insert with about 40 grains/cm$^2$ larger than 5 $\mu$m and about 15 grains/cm$^2$ larger than 7.5 $\mu$m a less pronounced striated binder phase structure in the inner part of the surface zone, part B, with a maximum Co-content of about 14 weight-% and a thickness of about 20 $\mu$m.

a somewhat thicker zone free of gamma phase (part A), of about 11 $\mu$m.

EXAMPLE 3

As a further reference inserts of type CNMG 120408-PM were pressed from the same powder mixture and sintered according to an identical sintering cycle as in example 2, except that the controlled cooling rate was 60° C./h and the SP-value was 9.0. The inserts were etched, edge-rounded and CVD coated according to example 1.

The structure of the inserts was essentially identical to that of example 2 except for a somewhat thicker zone free of gamma phase (part A), about 13 $\mu$m, and a more pronounced striated binder phase structure in the inner part of the surface zone, part B, with a maximum Co-content of about 23 weight-% and a thickness of about 30 $\mu$m.

EXAMPLE 4

With the CNMG 120408-inserts from examples 1, 2 and 3, a test consisting of an intermittent turning operation with cutting fluid in an unalloyed steel SS1312 was performed with the following cutting data:

Speed: 80 m/min

Feed: 0.40 mm/rev

Cutting depth: 2 mm 15 cutting edges of each variant were run until fracture or max 10 min tool life. The average tool life is shown in the table below.

| | Average tool life, min |
|---|---|
| Example 1 (invention) | 10 (no fracture) |
| Example 2 (known technique) | 7.1 |
| Example 3 (known technique) | 7.6 |

EXAMPLE 5

The inserts from examples 1, 2 and 3 were tested in a continuous turning operation in a tough-hardened steel, SS2541, with the hardness HB280. The following cutting data were used.

Speed: 140 m/min

Feed: 0.7 mm/rev

Cutting depth: 2.0 mm

Cutting time: 30 s

The operation led to a plastic deformation, which could be observed as an edge depression of the cutting edge. The edge depression was measured for five edges of each variant and average values were compared relative to each other giving the following result (low value means good result):

| | Relative edge depression |
|---|---|
| Example 1 (invention) | 1.00 |
| Example 2 (known technique) | 0.98 |
| Example 3 (known technique) | 1.14 |

From examples 4 and 5 it is evident that inserts according to the invention, example 1, exhibit a considerably better toughness behaviour than according to known technique without having significantly impaired deformation resistance. It is evident that a larger span in cutting properties and thereby application area can be obtained.

While the present invention has been described by reference to the above mentioned embodiments, certain modifiactions and variation will be evident to those of ordinary skill in the art. Therefore, the present invention is to be limited only by the scope and spirit of the appended claims.

What is claimed is:

1. A cemented carbide comprising WC, 2–10 wt-% Co, 4–15 wt-% cubic carbides with a binder phase enriched surface zone essentially free of gamma phase, the WC-grains have an average grain size of 1.0–3.5 $\mu$m, and that the number of WC-grains larger than 2 times the average grain size is less than 10 grains/cm$^2$ measured on a representative polished section 0.5 cm$^2$ in area, and the number of grains larger than 3 times the average grain size is less than 5 grains/cm$^2$ as measured over the section area.

2. The cemented carbide of claim 1, wherein the cubic carbides comprise at least one of TiC, TaC and NbC.

3. The cemented carbide of claim 1, wherein the average WC grain size is 1.3–3.0 $\mu$m.

4. The cemented carbide of claim 1, wherein the number of WC grains larger than 2 times the average grain size is less than 5 grains/cm$^2$ over the polished section.

5. The cemented carbide of claim 3, wherein the surface zone comprises an inner part and an outer part, wherein the outer part is binder-phase enriched.

6. A method of making a cemented carbide having a binder phase enriched surface zone, the method comprising:

subjecting WC to a process which removes fine and coarse grains to produce a WC powder having a grain size distribution of 0.1 $d_m$–3.0 $d_m$, where $d_m$ is a desired average grain size;

coating the WC powder with a binder material;

wet mixing, without milling, the coated WC powder with additional constituents, such that no change in grain size or grain size distribution is produced, thereby forming a slurry;

drying the slurry to form a dried powder;

subjecting the dried powder to a forming process thereby producing a green body;

sintering the green body, thereby forming a sintered body; and cooling the sintered body;

whereby the sintering and cooling steps are performed such that the following relationship is satisfied:

$$CR\cdot(ST-1300)/1000=10-17,$$

wherein CR is the cooling rate in ° C./h and ST is the sintering temperature in ° C.

7. The method of claim 6, wherein the grain size distribution is 0.2 $d_m$–2.0 $d_m$.

8. The method of claim 6, wherein the added constituents comprise cubic carbides and a pressing agent.

9. The method of claim 8, wherein the added constituents further comprise carbides, nitrides, and additional binder material.

10. The method of claim 6, wherein the binder material comprises Co.

11. The method of claim 6, wherein CR·(ST-1300)/1000= 11–16.

* * * * *